US012449232B2

(12) United States Patent
Wei

(10) Patent No.: US 12,449,232 B2
(45) Date of Patent: Oct. 21, 2025

(54) WEAPON STORAGE BOX WITH DEFENSE FUNCTION

(71) Applicant: Kongming Wei, Suzhou (CN)

(72) Inventor: Kongming Wei, Suzhou (CN)

(73) Assignee: NANJING EASTHOUSE ELECTRICAL CO., LTD., Jiangsu (CN)

( * ) Notice: Subject to any disclaimer, the term of this patent is extended or adjusted under 35 U.S.C. 154(b) by 56 days.

(21) Appl. No.: 18/435,835

(22) Filed: Feb. 7, 2024

(65) Prior Publication Data

US 2025/0237474 A1 Jul. 24, 2025

(30) Foreign Application Priority Data

Jan. 18, 2024 (CN) ..... 202410075724.6

(51) Int. Cl.
*F41C 33/06* (2006.01)
*F41H 5/08* (2006.01)

(52) U.S. Cl.
CPC ..... *F41C 33/06* (2013.01); *F41H 5/08* (2013.01)

(58) Field of Classification Search
CPC ..... B65D 1/00; B65D 1/02; B65D 1/0207; B65D 1/0215; B65D 1/0223; B65D 1/023; B65D 1/0246; B65D 1/0276; B65D 1/0292; B65D 1/04; B65D 1/06; B65D 1/10; B65D 1/14; B65D 1/165; B65D 1/20; B65D 1/22; B65D 1/225; B65D 1/24; B65D 1/243; B65D 1/246; B65D 1/26; B65D 1/265; B65D 1/28; B65D 1/32; B65D 1/34; B65D 1/36; B65D 1/40; B65D 1/46; B65D 1/48; B65D 11/00; B65D 11/02; B65D 11/04;
(Continued)

(56) References Cited

U.S. PATENT DOCUMENTS 2,240,790 A * 5/1941 Agnes ..... E05D 11/105 16/334
2,295,494 A * 9/1942 Valentine ..... E05D 11/105 220/829

(Continued)

FOREIGN PATENT DOCUMENTS

CN 1228503 A * 9/1999 ..... B65D 88/129
CN 2823492 Y * 10/2006 ..... E05G 1/00

(Continued)

*Primary Examiner* — Anthony D Stashick
*Assistant Examiner* — Marcos Javier Rodriguez Molina
(74) *Attorney, Agent, or Firm* — Ming Jiang; MM IP SERVICES LLC

(57) ABSTRACT

A weapon storage box with a defense function includes a box body upper cover and a box body lower cover; the box body upper cover and the box body lower cover are rotationally connected and can be switched between a closing state and an unfolding state; a box lock is arranged between the box body upper cover and the box body lower cover; the box body upper cover and the box body lower cover is provided with a handle positioned in a storage cavity, the box body upper cover and the box body lower cover are spliced to form a shield in the unfolding state. According to the disclosure, the weapon storage box can be used as a box for storing weapons and can be carried around, and can also be used as the shield for protecting the user safety in time.

9 Claims, 5 Drawing Sheets

(58) Field of Classification Search

CPC ..... B65D 11/08; B65D 11/10; B65D 11/18; B65D 11/1806; B65D 11/1826; B65D 11/1833; B65D 11/184; B65D 11/1853; B65D 11/186; B65D 11/1866; B65D 11/1873; B65D 11/188; B65D 11/20; B65D 11/22; B65D 11/26; B65D 11/28; B65D 13/00; B65D 13/02; B65D 15/02; B65D 15/08; B65D 15/22; B65D 15/24; B65D 17/02; B65D 17/28; B65D 17/34; B65D 17/401; B65D 17/4012; B65D 17/4014; B65D 17/506; B65D 17/521; B65D 19/00; B65D 19/0002; B65D 19/0018; B65D 19/0095; B65D 19/06; B65D 19/08; B65D 19/10; B65D 19/12; B65D 19/18; B65D 19/38; B65D 19/385; B65D 19/44; B65D 21/02; B65D 21/0204; B65D 21/0205; B65D 21/0209; B65D 21/0212; B65D 21/0213; B65D 21/0215; B65D 21/0219; B65D 21/022; B65D 21/0222; B65D 21/0223; B65D 21/0224; B65D 21/0226; B65D 21/0228; B65D 21/023; B65D 21/0233; B65D 21/0234; B65D 21/0237; B65D 21/04; B65D 21/062; B65D 21/064; B65D 21/068; B65D 21/08; B65D 21/083; B65D 21/086; B65D 2201/00; B65D 2203/00; B65D 2203/02; B65D 2203/04; B65D 2203/06; B65D 2203/10; B65D 2203/12; B65D 2205/00; B65D 2205/02; B65D 2211/00; B65D 2213/00; B65D 2215/02; B65D 2215/04; B65D 2215/06; B65D 2231/005; B65D 2231/02; B65D 2231/022; B65D 2231/027; B65D 2251/0009; B65D 2251/0012; B65D 2251/0015; B65D 2251/0018; B65D 2251/0021; B65D 2251/0025; B65D 2251/0028; B65D 2251/0056; B65D 2251/0071; B65D 2251/0075; B65D 2251/0078; B65D 2251/0081; B65D 2251/0087; B65D 2251/009; B65D 2251/0093; B65D 2251/0096; B65D 2251/01; B65D 2251/02; B65D 2251/023; B65D 2251/026; B65D 2251/04; B65D 2251/06; B65D 2251/08; B65D 2251/10; B65D 2251/1008; B65D 2251/1015; B65D 2251/1016; B65D 2251/1025; B65D 2251/1033; B65D 2251/1041; B65D 2251/105; B65D 2251/1058; B65D 2251/1066; B65D 2251/1075; B65D 2251/1083; B65D 2251/1091; B65D 2251/20; B65D 2251/205; B65D 2255/00; B65D 2255/20; B65D 23/00; B65D 23/001; B65D 23/12; B65D 23/14; B65D 2301/10; B65D 2313/00; B65D 2313/02; B65D 2313/04; B65D 2401/00; B65D 2401/05; B65D 2401/10; B65D 2401/15; B65D 2401/20; B65D 2401/25; B65D 2401/30; B65D 2401/35; B65D 2401/45; B65D 2401/55; B65D 2401/60; B65D 25/00; B65D 25/005; B65D 25/02; B65D 25/04; B65D 25/06; B65D 25/08; B65D 25/10; B65D 25/101; B65D 25/102; B65D 25/103; B65D 25/105; B65D 25/106; B65D 25/107; B65D 25/108; B65D 25/14; B65D 25/16; B65D 25/20; B65D 25/205; B65D 25/22; B65D 25/24; B65D 25/28; B65D 25/2802; B65D 25/2805; B65D 25/2808; B65D 25/282; B65D 25/2826; B65D 25/2835; B65D 25/2844; B65D 25/2858; B65D 25/2867; B65D 25/2873; B65D 25/2882; B65D 25/2885; B65D 25/2888; B65D 25/2894; B65D 25/2897; B65D 25/30; B65D 25/32; B65D 25/34; B65D 25/38; B65D 25/40; B65D 25/42; B65D 25/44; B65D 25/465; B65D 25/48; B65D 25/52; B65D 25/54; B65D 2501/24019; B65D 2501/24082; B65D 2501/24095; B65D 2501/24127; B65D 2501/24146; B65D 2501/24222; B65D 2501/24267; B65D 2501/2428; B65D 2501/24286; B65D 2501/24312; B65D 2501/2435; B65D 2501/24541; B65D 2501/24859; B65D 2501/24872; B65D 2501/2491; B65D 2517/0011; B65D 2517/0013; B65D 2517/0014; B65D 2517/0017; B65D 2517/002; B65D 2517/0032; B65D 2517/0034; B65D 2517/004; B65D 2517/0041; B65D 2517/0043; B65D 2517/0046; B65D 2517/0049; B65D 2517/0052; B65D 2517/0056; B65D 2517/0062; B65D 2517/0082; B65D 2517/0094; B65D 2517/0097; B65D 2517/5091; B65D 2519/00024; B65D 2519/00029; B65D 2519/00034; B65D 2519/00059; B65D 2519/00064; B65D 2519/00069; B65D 2519/00099; B65D 2519/00104; B65D 2519/00129; B65D 2519/00164; B65D 2519/00174; B65D 2519/00184; B65D 2519/00199; B65D 2519/00208; B65D 2519/00233; B65D 2519/00268; B65D 2519/00273; B65D 2519/00288; B65D 2519/00293; B65D 2519/00298; B65D 2519/00318; B65D 2519/00323; B65D 2519/00333; B65D 2519/00338; B65D 2519/00343; B65D 2519/00353; B65D 2519/00373; B65D 2519/00407; B65D 2519/00412; B65D 2519/00422; B65D 2519/00432; B65D 2519/00497; B65D 2519/00502; B65D 2519/00512; B65D 2519/00522; B65D 2519/00532; B65D 2519/00562; B65D 2519/00567; B65D 2519/00572; B65D 2519/00582; B65D 2519/00587; B65D 2519/00592; B65D 2519/00597; B65D 2519/00601; B65D 2519/00611; B65D 2519/00626; B65D 2519/00636; B65D 2519/00641; B65D 2519/00646; B65D 2519/00651; B65D 2519/00656; B65D 2519/00661; B65D 2519/00666; B65D 2519/00691; B65D 2519/00701; B65D 2519/00711; B65D 2519/00731; B65D 2519/00761; B65D 2519/00771; B65D 2519/00781; B65D 2519/008; B65D 2519/00805; B65D 2519/00815; B65D 2519/009; B65D 2519/00905; B65D 2519/00915; B65D 2519/0096; B65D 2519/00965; B65D 2519/00975; B65D 2519/0099; B65D 2525/282; B65D

2525/283; B65D 2525/284; B65D 2543/00009; B65D 2543/00018; B65D 2543/00027; B65D 2543/00046; B65D 2543/00092; B65D 2543/00101; B65D 2543/0012; B65D 2543/00175; B65D 2543/00194; B65D 2543/00203; B65D 2543/00222; B65D 2543/00231; B65D 2543/0024; B65D 2543/0025; B65D 2543/00268; B65D 2543/00277; B65D 2543/00296; B65D 2543/00305; B65D 2543/00314; B65D 2543/00324; B65D 2543/00351; B65D 2543/00361; B65D 2543/00379; B65D 2543/00407; B65D 2543/00416; B65D 2543/00435; B65D 2543/00462; B65D 2543/0049; B65D 2543/005; B65D 2543/00509; B65D 2543/00518; B65D 2543/00527; B65D 2543/00537; B65D 2543/00546; B65D 2543/00555; B65D 2543/00564; B65D 2543/00574; B65D 2543/00583; B65D 2543/00592; B65D 2543/00601; B65D 2543/00611; B65D 2543/0062; B65D 2543/00629; B65D 2543/00638; B65D 2543/00648; B65D 2543/00657; B65D 2543/00666; B65D 2543/00675; B65D 2543/00685; B65D 2543/00694; B65D 2543/00703; B65D 2543/00712; B65D 2543/00731; B65D 2543/0074; B65D 2543/0075; B65D 2543/00759; B65D 2543/00777; B65D 2543/00787; B65D 2543/00796; B65D 2543/00805; B65D 2543/00814; B65D 2543/00824; B65D 2543/00833; B65D 2543/00842; B65D 2543/00851; B65D 2543/0087; B65D 2543/00888; B65D 2543/00898; B65D 2543/00907; B65D 2543/00944; B65D 2543/00953; B65D 2543/00972; B65D 2543/0099; B65D 2547/06; B65D 2547/063; B65D 2547/066; B65D 2555/02; B65D 2563/107; B65D 2565/385; B65D 2571/00141; B65D 2571/00172; B65D 2571/00277; B65D 2571/0045; B65D 2571/00469; B65D 2571/00524; B65D 2571/00543; B65D 2571/0058; B65D 2571/0066; B65D 2571/00716; B65D 2571/00728; B65D 2575/3218; B65D 2575/3245; B65D 2575/367; B65D 2575/368; B65D 2575/586; B65D 2577/045; B65D 2581/055; B65D 2581/3421; B65D 2581/3494; B65D 2583/005; B65D 2583/0404; B65D 2583/0409; B65D 2583/0422; B65D 2583/0486; B65D 2583/049; B65D 2583/0495; B65D 2585/366; B65D 2585/56; B65D 2585/649; B65D 2585/686; B65D 2585/6865; B65D 2585/6867; B65D 2585/687; B65D 2585/6872; B65D 2585/6882; B65D 2585/86; B65D 2585/88; B65D 2588/54; B65D 2590/0058; B65D 2590/0066; B65D 2590/0075; B65D 2590/0083; B65D 2590/0091; B65D 2590/026; B65D 2590/542; B65D 2590/66; B65D 2590/664; B65D 2590/666; B65D 27/22; B65D 27/28; B65D 27/30; B65D 29/00; B65D 3/14; B65D 3/22; B65D 3/26; B65D 3/268; B65D 3/28; B65D 31/06; B65D 31/10; B65D 31/12; B65D 31/14; B65D 31/147; B65D 31/16; B65D 33/00; B65D 33/001; B65D 33/004; B65D 33/007; B65D 33/01; B65D 33/02; B65D 33/04; B65D 33/065; B65D 33/105; B65D 33/14; B65D 33/16; B65D 33/1675; B65D 33/20; B65D 33/24; B65D 33/25; B65D 33/2508; B65D 33/2516; B65D 33/2541; B65D 33/28; B65D 33/34; B65D 35/08; B65D 35/14; B65D 35/28; B65D 35/30; B65D 35/44; B65D 37/00; B65D 39/00; B65D 39/04; B65D 39/08; B65D 39/084; B65D 39/088; B65D 39/10; B65D 39/12; B65D 39/16; B65D 41/00; B65D 41/005; B65D 41/02; B65D 41/04; B65D 41/0414; B65D 41/0428; B65D 41/0435; B65D 41/045; B65D 41/0471; B65D 41/0485; B65D 41/0492; B65D 41/06; B65D 41/083; B65D 41/16; B65D 41/20; B65D 41/26; B65D 41/28; B65D 41/32; B65D 41/325; B65D 41/34; B65D 41/3404; B65D 41/3409; B65D 41/3423; B65D 41/3428; B65D 41/3442; B65D 41/3447; B65D 41/3457; B65D 41/365; B65D 41/385; B65D 41/47; B65D 41/48; B65D 41/485; B65D 41/50; B65D 41/58; B65D 41/62; B65D 43/00; B65D 43/02; B65D 43/0202; B65D 43/0204; B65D 43/0206; B65D 43/0208; B65D 43/021; B65D 43/0212; B65D 43/0214; B65D 43/0216; B65D 43/0218; B65D 43/022; B65D 43/0222; B65D 43/0225; B65D 43/0229; B65D 43/0231; B65D 43/0235; B65D 43/0239; B65D 43/0249; B65D 43/0254; B65D 43/0256; B65D 43/0262; B65D 43/0268; B65D 43/0274; B65D 43/0283; B65D 43/06; B65D 43/065; B65D 43/08; B65D 43/12; B65D 43/14; B65D 43/16; B65D 43/161; B65D 43/162; B65D 43/163; B65D 43/164; B65D 43/165; B65D 43/166; B65D 43/167; B65D 43/168; B65D 43/169; B65D 43/18; B65D 43/20; B65D 43/22; B65D 43/24; B65D 43/26; B65D 43/262; B65D 43/265; B65D 43/267; B65D 45/00; B65D 45/02; B65D 45/04; B65D 45/06; B65D 45/16; B65D 45/18; B65D 45/20; B65D 45/22; B65D 45/24; B65D 45/28; B65D 45/30; B65D 45/32; B65D 45/322; B65D 45/325; B65D 45/327; B65D 45/34; B65D 45/345; B65D 47/046; B65D 47/06; B65D 47/065; B65D 47/066; B65D 47/08; B65D 47/0804; B65D 47/0809; B65D 47/0814; B65D 47/0819; B65D 47/0823; B65D 47/0828; B65D 47/0833; B65D 47/0838; B65D 47/0842; B65D 47/0847; B65D 47/0852; B65D 47/0857; B65D 47/0861; B65D 47/0866; B65D 47/0871; B65D 47/0876; B65D 47/088; B65D 47/0885; B65D 47/089; B65D 47/0895; B65D 47/10;

B65D 47/103; B65D 47/12; B65D 47/121; B65D 47/122; B65D 47/123; B65D 47/125; B65D 47/127; B65D 47/128; B65D 47/14; B65D 47/142; B65D 47/147; B65D 47/18; B65D 47/185; B65D 47/20; B65D 47/2006; B65D 47/2012; B65D 47/2018; B65D 47/2025; B65D 47/2031; B65D 47/24; B65D 47/242; B65D 47/243; B65D 47/244; B65D 47/248; B65D 47/249; B65D 47/261; B65D 47/265; B65D 47/268; B65D 47/283; B65D 47/286; B65D 47/305; B65D 47/32; B65D 47/36; B65D 47/42; B65D 49/02; B65D 5/0015; B65D 5/005; B65D 5/0085; B65D 5/02; B65D 5/0227; B65D 5/0236; B65D 5/0245; B65D 5/0254; B65D 5/10; B65D 5/106; B65D 5/12; B65D 5/18; B65D 5/20; B65D 5/2033; B65D 5/2038; B65D 5/2047; B65D 5/2057; B65D 5/22; B65D 5/24; B65D 5/241; B65D 5/246; B65D 5/248; B65D 5/28; B65D 5/302; B65D 5/308; B65D 5/322; B65D 5/325; B65D 5/36; B65D 5/3614; B65D 5/3621; B65D 5/3635; B65D 5/3642; B65D 5/3657; B65D 5/3678; B65D 5/38; B65D 5/40; B65D 5/42; B65D 5/4204; B65D 5/4208; B65D 5/425; B65D 5/4266; B65D 5/4291; B65D 5/4295; B65D 5/441; B65D 5/443; B65D 5/445; B65D 5/46016; B65D 5/4608; B65D 5/48002; B65D 5/48014; B65D 5/5002; B65D 5/5021; B65D 5/5023; B65D 5/5028; B65D 5/503; B65D 5/5035; B65D 5/5038; B65D 5/504; B65D 5/5042; B65D 5/5088; B65D 5/5206; B65D 5/5213; B65D 5/5253; B65D 5/528; B65D 5/54; B65D 5/5415; B65D 5/542; B65D 5/5425; B65D 5/543; B65D 5/5435; B65D 5/5445; B65D 5/5455; B65D 5/5485; B65D 5/563; B65D 5/566; B65D 5/606; B65D 5/64; B65D 5/643; B65D 5/66; B65D 5/6608; B65D 5/6611; B65D 5/6614; B65D 5/662; B65D 5/6632; B65D 5/665; B65D 5/6652; B65D 5/6658; B65D 5/6661; B65D 5/6664; B65D 5/6667; B65D 5/667; B65D 5/6685; B65D 5/6688; B65D 5/6691; B65D 5/6697; B65D 5/68; B65D 5/685; B65D 5/706; B65D 5/721; B65D 5/724; B65D 5/74; B65D 5/742; B65D 5/746; B65D 5/748; B65D 5/749; B65D 50/00; B65D 50/02; B65D 50/04; B65D 50/041; B65D 50/045; B65D 50/046; B65D 50/06; B65D 50/061; B65D 50/062; B65D 50/066; B65D 50/067; B65D 50/069; B65D 51/00; B65D 51/002; B65D 51/007; B65D 51/04; B65D 51/10; B65D 51/14; B65D 51/145; B65D 51/16; B65D 51/1605; B65D 51/1611; B65D 51/1622; B65D 51/1644; B65D 51/165; B65D 51/1672; B65D 51/1677; B65D 51/1683; B65D 51/1688; B65D 51/1694; B65D 51/18; B65D 51/20; B65D 51/22; B65D 51/222; B65D 51/224; B65D 51/24; B65D 51/241; B65D 51/242; B65D 51/243; B65D 51/245; B65D 51/246; B65D 51/247; B65D 51/248; B65D 51/249; B65D 51/26; B65D 51/28; B65D 51/2807; B65D 51/2814; B65D 51/2821; B65D 51/2828; B65D 51/2835; B65D 51/2842; B65D 51/2892; B65D 51/32; B65D 53/00; B65D 53/02; B65D 53/04; B65D 53/06; B65D 55/00; B65D 55/02; B65D 55/022; B65D 55/024; B65D 55/026; B65D 55/04; B65D 55/06; B65D 55/0818; B65D 55/10; B65D 55/12; B65D 55/14; B65D 55/145; B65D 55/16; B65D 59/04; B65D 59/06; B65D 63/1009; B65D 63/1027; B65D 63/1063; B65D 63/1072; B65D 65/14; B65D 65/16; B65D 65/18; B65D 65/38; B65D 65/40; B65D 65/403; B65D 65/42; B65D 65/46; B65D 65/466; B65D 7/00; B65D 7/16; B65D 7/24; B65D 7/26; B65D 7/32; B65D 7/42; B65D 71/00; B65D 71/0003; B65D 71/0037; B65D 71/0055; B65D 71/0096; B65D 71/12; B65D 71/14; B65D 71/22; B65D 71/36; B65D 71/70; B65D 73/00; B65D 73/0014; B65D 73/0057; B65D 73/0092; B65D 73/02; B65D 75/00; B65D 75/002; B65D 75/008; B65D 75/04; B65D 75/12; B65D 75/20; B65D 75/22; B65D 75/30; B65D 75/326; B65D 75/327; B65D 75/34; B65D 75/366; B65D 75/367; B65D 75/46; B65D 75/52; B65D 75/525; B65D 75/54; B65D 75/56; B65D 75/566; B65D 75/58; B65D 75/5805; B65D 75/5827; B65D 75/5833; B65D 75/5838; B65D 75/5844; B65D 75/5855; B65D 75/5866; B65D 75/5872; B65D 75/5877; B65D 75/5883; B65D 77/00; B65D 77/003; B65D 77/02; B65D 77/04; B65D 77/0406; B65D 77/0446; B65D 77/0453; B65D 77/0466; B65D 77/048; B65D 77/0486; B65D 77/0493; B65D 77/06; B65D 77/061; B65D 77/067; B65D 77/12; B65D 77/185; B65D 77/2032; B65D 77/2088; B65D 77/22; B65D 77/225; B65D 77/24; B65D 77/245; B65D 77/26; B65D 77/28; B65D 77/283; B65D 77/30; B65D 77/38; B65D 79/0081; B65D 79/0087; B65D 79/02; B65D 81/02; B65D 81/03; B65D 81/05; B65D 81/051; B65D 81/052; B65D 81/053; B65D 81/07; B65D 81/075; B65D 81/09; B65D 81/107; B65D 81/113; B65D 81/1275; B65D 81/18; B65D 81/20; B65D 81/2015; B65D 81/2023; B65D 81/2038; B65D 81/2053; B65D 81/2069; B65D 81/2076; B65D 81/22; B65D 81/24; B65D 81/26; B65D 81/261; B65D 81/263; B65D 81/264; B65D 81/266; B65D 81/268; B65D 81/28; B65D 81/30; B65D 81/32; B65D 81/3205; B65D 81/3211; B65D 81/3216; B65D 81/3222; B65D 81/325; B65D 81/3255; B65D 81/3261; B65D 81/3266;

B65D 81/3288; B65D 81/34; B65D 81/3453; B65D 81/3476; B65D 81/36; B65D 81/365; B65D 81/38; B65D 81/3806; B65D 81/3813; B65D 81/3816; B65D 81/3818; B65D 81/3823; B65D 81/3825; B65D 81/3834; B65D 81/3839; B65D 81/3841; B65D 81/3848; B65D 81/386; B65D 81/3862; B65D 81/3865; B65D 81/3869; B65D 81/3876; B65D 83/00; B65D 83/0005; B65D 83/0027; B65D 83/0038; B65D 83/0055; B65D 83/0072; B65D 83/0094; B65D 83/02; B65D 83/04; B65D 83/0409; B65D 83/0418; B65D 83/0445; B65D 83/0454; B65D 83/0463; B65D 83/0481; B65D 83/06; B65D 83/08; B65D 83/0805; B65D 83/0811; B65D 83/0823; B65D 83/0829; B65D 83/0835; B65D 83/0841; B65D 83/0847; B65D 83/087; B65D 83/0894; B65D 83/14; B65D 83/141; B65D 83/145; B65D 83/16; B65D 83/164; B65D 83/166; B65D 83/18; B65D 83/184; B65D 83/20; B65D 83/201; B65D 83/202; B65D 83/203; B65D 83/205; B65D 83/206; B65D 83/207; B65D 83/22; B65D 83/226; B65D 83/228; B65D 83/24; B65D 83/26; B65D 83/262; B65D 83/267; B65D 83/285; B65D 83/30; B65D 83/303; B65D 83/306; B65D 83/345; B65D 83/38; B65D 83/384; B65D 83/386; B65D 83/388; B65D 83/40; B65D 83/42; B65D 83/44; B65D 83/46; B65D 83/48; B65D 83/52; B65D 83/54; B65D 83/56; B65D 83/60; B65D 83/62; B65D 83/64; B65D 83/646; B65D 83/66; B65D 83/663; B65D 83/68; B65D 83/682; B65D 83/685; B65D 83/752; B65D 83/753; B65D 83/756; B65D 83/76; B65D 83/766; B65D 83/771; B65D 83/775; B65D 85/00; B65D 85/04; B65D 85/07; B65D 85/10; B65D 85/1009; B65D 85/1018; B65D 85/1027; B65D 85/1036; B65D 85/1045; B65D 85/1048; B65D 85/10484; B65D 85/1054; B65D 85/1056; B65D 85/10564; B65D 85/10566; B65D 85/10568; B65D 85/1063; B65D 85/1072; B65D 85/1081; B65D 85/12; B65D 85/187; B65D 85/20; B65D 85/24; B65D 85/28; B65D 85/30; B65D 85/32; B65D 85/324; B65D 85/34; B65D 85/36; B65D 85/38; B65D 85/48; B65D 85/50; B65D 85/505; B65D 85/52; B65D 85/54; B65D 85/544; B65D 85/58; B65D 85/60; B65D 85/62; B65D 85/672; B65D 85/68; B65D 85/70; B65D 85/72; B65D 85/76; B65D 85/78; B65D 85/80; B65D 85/804; B65D 85/8043; B65D 85/8049; B65D 85/8052; B65D 85/8055; B65D 85/8058; B65D 85/8061; B65D 85/8064; B65D 85/8067; B65D 85/808; B65D 85/82; B65D 88/00; B65D 88/005; B65D 88/02; B65D 88/022; B65D 88/027; B65D 88/06; B65D 88/10; B65D 88/12; B65D 88/121; B65D 88/123; B65D 88/126; B65D 88/127; B65D 88/128; B65D 88/129; B65D 88/14; B65D 88/26; B65D 88/28; B65D 88/30; B65D 88/34; B65D 88/42; B65D 88/52; B65D 88/522; B65D 88/524; B65D 88/528; B65D 88/54; B65D 88/546; B65D 88/56; B65D 88/58; B65D 88/64; B65D 88/66; B65D 88/68; B65D 88/74; B65D 88/744; B65D 88/76; B65D 88/78; B65D 9/12; B65D 9/14; B65D 9/18; B65D 9/20; B65D 9/32; B65D 9/34; B65D 9/38; B65D 90/00; B65D 90/0006; B65D 90/0013; B65D 90/0026; B65D 90/0033; B65D 90/006; B65D 90/0066; B65D 90/008; B65D 90/0086; B65D 90/02; B65D 90/021; B65D 90/022; B65D 90/023; B65D 90/026; B65D 90/04; B65D 90/046; B65D 90/06; B65D 90/08; B65D 90/10; B65D 90/105; B65D 90/12; B65D 90/14; B65D 90/18; B65D 90/205; B65D 90/22; B65D 90/24; B65D 90/34; B65D 90/44; B65D 90/48; B65D 90/54; B65D 90/587; B65D 90/60; B65D 90/62; B65D 90/623; B65D 90/626; B65D 90/66; E05C 17/00; E05D 11/10; E05D 11/105; F41C 23/00; F41C 23/02; F41C 23/04; F41C 23/06; F41C 23/08; F41C 23/10; F41C 23/12; F41C 23/14; F41C 23/16; F41C 23/18; F41C 23/20; F41C 23/22; F41C 27/00; F41C 27/04; F41C 27/06; F41C 27/16; F41C 27/18; F41C 27/22; F41C 3/00; F41C 3/02; F41C 3/08; F41C 3/14; F41C 33/00; F41C 33/001; F41C 33/002; F41C 33/003; F41C 33/005; F41C 33/006; F41C 33/007; F41C 33/008; F41C 33/02; F41C 33/0209; F41C 33/0218; F41C 33/0227; F41C 33/0236; F41C 33/0245; F41C 33/0254; F41C 33/0263; F41C 33/0272; F41C 33/0281; F41C 33/029; F41C 33/04; F41C 33/041; F41C 33/043; F41C 33/045; F41C 33/046; F41C 33/048; F41C 33/06; F41C 7/00; F41C 7/02; F41C 7/025; F41C 7/06; F41C 7/11; F41C 9/00; F41C 9/02; F41C 9/06; F41C 9/08; F41C 9/085; F41H 5/08

USPC ..... 2/262; 5/133, 174, 2.1, 32.1, 600, 722; 12/136 R; 14/36, 50; 16/231; 24/97; 38/139; 40/119, 446, 524, 530, 647; 42/1.06, 1.16, 105, 106, 111, 113, 114, 42/124, 129, 140, 146, 148, 16, 18, 40, 42/41, 42.01, 43, 44, 46, 49.01, 54, 63, 42/68, 69.01, 69.02, 69.03, 70.01, 70.06, 42/70.07, 70.11, 71.01, 71.02, 72, 73, 42/75.01, 75.02, 75.03, 75.04, 76.01, 79, 42/85, 90, 94, 96, 98; 49/1, 104, 107, 49/109, 118, 125, 126, 127, 13, 131, 139, 49/14, 141, 142, 143, 149, 15, 152, 153, 49/157, 158, 159, 160, 161, 162, 163, 49/164, 166, 168, 169, 17, 170, 171, 175, 49/176, 177, 178, 179, 180, 181, 183, 49/186, 187, 188, 189, 190, 191, 192, 49/193, 195, 197, 199, 200, 201, 202, 49/208, 21, 211, 216, 218, 219, 221, 223, 49/236, 239, 24, 240, 241, 242, 243, 246,

49/247, 248, 249, 25, 250, 252, 253, 254, 49/255, 256, 257, 258, 259, 26, 260, 261, 49/263, 276, 277, 278, 279, 28, 280, 281, 49/291, 30, 300, 302, 303, 306, 308, 31, 49/314, 316, 317, 319, 321, 322, 323, 49/324, 325, 33, 331, 333, 334, 335, 337, 49/339, 34, 340, 341, 342, 344, 345, 346, 49/347, 348, 349, 35, 350, 352, 354, 355, 49/356, 357, 358, 36, 360, 362, 364, 366, 49/367, 368, 37, 371, 372, 374, 378, 379, 49/380, 381, 382, 383, 384, 386, 387, 49/388, 389, 390, 391, 394, 395, 396, 49/397, 398, 399, 40, 400, 401, 402, 404, 49/41, 413, 425, 44, 445, 449, 450, 455, 49/460, 462, 463, 464, 465, 466, 467, 49/469, 470, 471, 475.1, 476.1, 477.1, 49/478.1, 480.1, 483.1, 484.1, 489.1, 49, 49/490.1, 493.1, 495.1, 496.1, 498.1, 50, 49/501, 502, 503, 504, 505, 506, 507, 55, 49/56, 57, 61, 62, 63, 64, 65, 67, 68, 70, 49/71, 73.1, 74.1, 8, 80.1, 81.1, 82.1, 49/87.1, 9, 90.1, 91.1, 95, 98, DIG. 1, 49/DIG. 2; 70/1.5, 10, 100, 101, 102, 70/103, 104, 105, 107, 108, 11, 114, 116, 70/118, 119, 120, 121, 123, 128, 129, 13, 70/131, 133, 134, 135, 137, 139, 14, 140, 70/141, 144, 149, 15, 150, 151 R, 153, 70/156, 158, 159, 16, 160, 161, 162, 163, 70/164, 165, 166, 167, 168, 169, 17, 173, 70/174, 175, 176, 177, 178, 179, 18, 180, 70/181, 182, 185, 186, 19, 199, 2, 20, 70/200, 202, 203, 207, 208, 209, 210, 70/211, 212, 214, 215, 224, 225, 226, 70/227, 228, 229, 230, 232, 233, 234, 70/235, 237, 238, 239, 240, 241, 243, 70/247, 25, 252, 255, 256, 257, 258, 259, 70/260, 261, 262, 263, 264, 266, 267, 70/268, 269, 271, 272, 273, 275, 276, 70/277, 278.1, 278.7, 279.1, 280, 282, 70/283, 283.1, 284, 286, 288, 289, 298, 70/299, 3, 30, 300, 304, 306, 312, 314, 70/315, 316, 32, 327, 337, 339, 34, 344, 70/348, 355, 360, 361, 366, 367, 368, 70/369, 370, 371, 375, 379 R, 380, 386, 70/387, 389, 38 A, 38 C, 39, 392, 393, 70/395, 396, 398, 399, 401, 408, 409, 70/413, 416, 417, 418, 419, 422, 423, 70/424, 427, 428, 429, 43, 431, 432, 439, 70/440, 441, 447, 448, 449, 450, 451, 70/452, 455, 456 R, 457, 458, 459, 46, 70/461, 462, 465, 466, 467, 472, 489, 49, 70/490, 491, 493, 50, 52, 53, 54, 55, 56, 70/57, 57.1, 58, 59, 61, 62, 63, 64, 65, 70/66, 67, 68, 69, 7, 70, 71, 72, 73, 74, 70/75, 76, 77, 78, 79, 8, 80, 81, 82, 83, 70/84, 85, 89, 9, 90, 91, 92, 93, 94, 95, 70/DIG. 20, DIG. 26, DIG. 30, DIG. 34, 70/DIG. 42, DIG. 43, DIG. 48, DIG. 49, 70/DIG. 55, DIG. 56, DIG. 57, DIG. 58, 70/DIG. 60, DIG. 62, DIG. 63, DIG. 64, 70/DIG. 65, DIG. 79; 56/125; 63/19, 7, 63/9; 99/380, 402; 105/280, 321, 372; 108/115, 134, 65; 114/178, 29; 126/357.1; 150/119; 152/414; 168/7; 172/617, 640, 736; 182/163, 165; 184/90; 190/101, 110, 111, 18 A; 206/0.5, 0.6, 0.7, 0.81, 0.82, 0.83, 1.5, 206/1.7, 1.8, 100, 102, 106, 110, 115, 206/121, 129, 133, 134, 135, 137, 139, 206/140, 149, 15.2, 15.3, 151, 153, 170, 206/171, 173, 178, 194, 196, 202, 204, 206/205, 207, 210, 211, 213, 213.1, 214, 206/215, 216, 217, 219, 221, 222, 223, 206/225, 228, 229, 230, 232, 233, 234, 206/235, 236, 239, 241, 242, 246, 249, 206/250, 251, 252, 255, 256, 259, 261, 206/262, 263, 265, 266, 267, 268, 269, 206/271, 273, 276, 277, 278, 278.1, 287, 206/287.1, 289, 292, 293, 296, 298, 3, 206/301, 303, 304, 305, 307, 307.1, 308, 206/308.1, 308.2, 308.3, 309, 310, 311, 206/312, 313, 314, 315.1, 315.11, 315.2, 206/315.3, 315.4, 315.5, 315.6, 315.7, 206/315.9, 315.91, 316.1, 316.2, 317, 206/320, 322, 335, 349, 350, 356, 359, 206/361, 362, 362.1, 362.2, 362.3, 362.4, 206/363, 364, 365, 366, 368, 369, 37, 206/370, 371, 372, 373, 374, 375, 376, 206/377, 378, 379, 38, 38.1, 380, 382, 206/385, 386, 387.1, 387.11, 387.12, 206/387.13, 389, 39, 39.1, 39.2, 39.3, 206/39.7, 391, 397, 400, 401, 403, 405, 206/406, 408, 409, 411, 418, 419, 422, 206/423, 424, 425, 427, 428, 430, 434, 206/436, 438, 439, 440, 443, 445, 446, 206/449, 45.2, 45.21, 45.23, 45.24, 45.25, 206/45.28, 45.29, 451, 454, 455, 456, 206/457, 459.1, 459.5, 460, 461, 464, 206/467, 468, 469, 470, 472, 473, 478, 206/480, 482, 483, 484, 484.1, 485, 488, 206/493, 494, 496, 499, 5, 5.1, 501, 503, 206/504, 505, 506, 507, 508, 509, 511, 206/512, 514, 515, 517, 518, 519, 521, 206/521.1, 521.15, 521.4, 521.5, 521.6, 206/521.7, 521.8, 522, 523, 524, 524.1, 206/524.2, 524.3, 524.6, 524.7, 524.8, 206/524.9, 525, 525.1, 526, 528, 530, 206/531, 532, 533, 534, 534.1, 535, 536, 206/538, 539, 540, 541, 542, 545, 546, 206/547, 549, 553, 554, 555, 556, 557, 206/558, 559, 560, 561, 562, 563, 564, 206/565, 566, 569, 570, 571, 573, 575, 206/576, 577, 578, 579, 581, 583, 584, 206/585, 586, 587, 588, 590, 591, 592, 206/593, 594, 597, 599, 6, 6.1, 600, 63.3, 206/63.5, 69, 701, 703, 704, 705, 706, 206/707, 710, 711, 718, 719, 722, 723, 206/728, 736, 738, 740, 741, 742, 745, 206/746, 747, 748, 749, 751, 752, 753, 206/754, 755, 756, 758, 759, 760, 762, 206/763, 764, 765, 766, 768, 769, 77.1, 206/773, 774, 775, 776, 782, 784, 8, 803, 206/804, 806, 807, 811, 812, 813, 815, 206/817, 818, 819, 821, 822, 823, 828, 206/83, 831, 87, 88, 89, 9, 92, 93, 95, 96, 206/98; 211/169.1; 217/57, 83; 220/1.5, 220/1.6, 17.1, 2, 200, 202, 203.01, 220/203.05, 203.07, 203.09, 203.1, 220/203.17, 203.18, 203.19, 203.22, 220/203.23, 203.27, 203.28, 210, 211,

220/212, 212.5, 213, 214, 215, 218, 220, 220/224, 229, 23.2, 23.4, 23.6, 23.8, 220/23.83, 23.86, 23.87, 23.88, 23.89, 220/23.91, 230, 231, 232, 234, 235, 239, 220/240, 241, 242, 243, 244, 245, 246, 220/247, 250, 251, 252, 253, 254.1, 220/254.2, 254.3, 254.4, 254.5, 254.6, 220/254.7, 254.8, 254.9, 255, 255.1, 220/256.1, 257.1, 257.2, 258.1, 258.2, 220/258.3, 258.4, 258.5, 259.1, 259.2, 220/259.3, 259.4, 259.5, 260, 262, 263, 220/264, 265, 266, 267, 268, 269, 270, 220/271, 273, 274, 276, 277, 278, 281, 220/282, 283, 284, 285, 287, 288, 290, 220/291, 292, 293, 296, 297, 298, 3.2, 220/3.3, 3.4, 3.5, 3.6, 3.7, 3.8, 3.94, 300, 220/301, 302, 303, 304, 305, 309.2, 314, 220/315, 316, 317, 318, 319, 320, 321, 220/322, 323, 324, 325, 326, 327, 328, 220/345.1, 345.2, 345.3, 345.4, 345.5, 220/348, 349, 350, 351, 359.2, 360, 361, 220/366.1, 367.1, 370, 371, 372, 373, 220/374, 375, 376, 377, 378, 379, 380, 220/4.01, 4.02, 4.03, 4.04, 4.08, 4.12, 220/4.13, 4.16, 4.21, 4.22, 4.23, 4.24, 220/4.25, 4.26, 4.27, 4.28, 4.29, 4.31, 220/4.32, 4.33, 4.34, 475, 476, 477, 478, 220/479, 480, 481, 482, 484, 485, 486, 220/487, 494, 495, 495.01, 495.02, 220/495.04, 495.05, 495.06, 495.07, 220/495.08, 495.09, 495.11, 500, 501, 220/502, 503, 504, 505, 506, 507, 508, 220/512, 516, 519, 520, 521, 522, 523, 220/524, 525, 526, 527, 528, 529, 530, 220/531, 532, 533, 534, 535, 537, 541, 220/550, 551, 552, 553, 554, 555, 556, 220/557, 558, 559, 560, 560.01, 560.03, 220/560.04, 561, 562, 563, 564, 565, 220/567.1, 571, 573.1, 574, 574.1, 575, 220/576, 578, 579, 581, 582, 586, 592.01, 220/592.02, 592.03, 592.04, 592.09, 220/592.12, 592.14, 592.16, 592.17, 220/592.2, 592.21, 592.25, 6, 600, 601, 220/603, 609, 610, 615, 617, 62, 62.11, 220/62.14, 62.18, 62.2, 62.21, 62.22, 622, 220/627, 628, 629, 630, 631, 633, 639, 220/640, 641, 642, 646, 651, 656, 657, 220/659, 660, 661, 662, 665, 666, 668, 220/669, 670, 671, 675, 676, 677, 681, 220/682, 689, 690, 691, 692, 694, 697, 220/698, 7, 700, 703, 707, 708, 709, 711, 220/712, 713, 714, 715, 716, 717, 718, 220/719, 720, 724, 725, 727, 728, 729, 220/730, 731, 734, 735, 737, 738, 739, 220/740, 744, 745, 747, 751, 752, 754, 220/755, 756, 757, 758, 759, 760, 761, 220/762, 763, 765, 766, 768, 769, 770, 220/771, 772, 773, 774, 780, 781, 782, 220/783, 784, 785, 786, 787, 788, 789, 220/790, 791, 792, 793, 795, 796, 799, 8, 220/805, 806, 810, 811, 812, 813, 815, 220/816, 817, 818, 819, 820, 821, 822, 220/823, 824, 825, 826, 827, 828, 829, 220/830, 831, 832, 833, 834, 835, 836, 220/837, 838, 839, 840, 841, 842, 843, 220/844, 845, 847, 848; 220/849, 86.1, 220/86.2, 86.3, 87.1, 88.1, 89.1, 89.2, 220/890, 9.1, 9.2, 9.3, 9.4, 902, 903, 904, 220/906, 908, 908.1, 908.3, 909, 912, 220/915.1, 916, 918, DIG. 15, DIG. 19, 220/DIG. 2, DIG. 24, DIG. 25, DIG. 26, 220/DIG. 28, DIG. 32, DIG. 33, DIG. 6, 220/DIG. 9, FOR. 197; 224/153, 154, 224/155, 156, 158, 164, 179, 181, 182, 224/191, 196, 197, 198, 199, 201, 217, 224/218, 219, 222, 232, 240, 241, 242, 224/243, 245, 257, 264, 265, 266, 267, 224/268, 269, 270, 271, 272, 274, 275, 224/281, 282, 309, 310, 311, 312, 315, 224/316, 317, 319, 321, 323, 324, 325, 224/326, 327, 328, 331, 400, 401, 402, 224/403, 404, 405, 406, 411, 412, 413, 224/414, 419, 42.12, 42.13, 42.2, 42.21, 224/42.24, 42.26, 42.28, 42.32, 42.35, 224/420, 425, 427, 430, 431, 432, 434, 224/435, 44.5, 441, 448, 451, 483, 484, 224/485, 487, 488, 489, 495, 497, 498, 224/501, 502, 504, 506, 507, 509, 510, 224/512, 513, 518, 519, 520, 521, 522, 224/527, 528, 529, 530, 531, 532, 533, 224/536, 537, 539, 540, 541, 542, 543, 224/544, 545, 547, 549, 550, 553, 557, 224/558, 559, 560, 564, 567, 570, 571, 224/572, 576, 577, 583, 584, 607, 615, 224/616, 627, 629, 633, 634, 645, 654, 224/663, 671, 673, 674, 679, 901.4, 224/901.8, 903, 904, 910, 911, 912, 913, 224/914, 917, 917.5, 920, 924, 925, 926, 224/929, 930; 229/125.08; 256/26; 293/44; 296/146.1, 86, 92; 298/29; 301/32; 362/451; 396/345; 404/25; 408/180; 602/16

See application file for complete search history.

(56) References Cited

U.S. PATENT DOCUMENTS

| | | | | | |
|---|---|---|---|---|---|
| 4,308,939 | A * | 1/1982 | Eubanks | A45C 13/34 | 190/106 |
| 4,895,271 | A * | 1/1990 | Desjardins | E05D 11/1007 | 16/349 |
| 2008/0047860 | A1* | 2/2008 | Shane | F41C 33/06 | 206/317 |
| 2015/0314957 | A1* | 11/2015 | Reeb | E05B 65/06 | 220/315 |
| 2022/0145679 | A1* | 5/2022 | Bäumer | H02B 1/38 | |

FOREIGN PATENT DOCUMENTS

| | | | | |
|---|---|---|---|---|
| CN | 210689383 U | * | 6/2020 | F41C 33/06 |
| CN | 212843179 U | | 3/2021 | |
| CN | 216637595 U | | 5/2022 | |
| EP | 0263376 A | * | 4/1988 | E05D 11/06 |

* cited by examiner

WEAPON STORAGE BOX WITH DEFENSE FUNCTION

CROSS-REFERENCE TO RELATED APPLICATIONS

This application claims priority to Chinese Patent Application No. 202410075724.6, filed on Jan. 18, 2024, which is incorporated herein by reference in its entirety.

TECHNICAL FIELD

The disclosure herein relates to the technical field of storage boxes, and particularly relates to a weapon storage box with a defense function.

BACKGROUND

Safeguard devices such as guns and spontoons are generally stored in relatively safe storage boxes. According to the requirements of Specifications for Storage, the storage boxes must be opened with permission, such as gun storage boxes for military and police units and foreign civil gun storage boxes. For some execution tasks, emergencies, etc., the storage boxes also need to be easy to carry and move and used by different personnel as required. Current weapon storage boxes are generally boxes with internal storing cavities that can be opened, and the function is relatively single. In case of security risks, especially when there are no bunkers around, timely personal protection cannot be achieved, and especially in foreign areas where gun control is not available, personal safety cannot be guaranteed. Therefore, it is necessary to improve the existing technology to overcome the defects in the existing technology.

SUMMARY

The disclosure provides a weapon storage box with a defense function, aiming to overcome defects that an existing weapon storage box is single in function and cannot protect personal safety of the user in time.

In order to solve the technical problem, technical solutions adopted in the disclosure are that: a weapon storage box with a defense function includes: a box body upper cover, and a box body lower cover; the box body upper cover and the box body lower cover are rotationally connected and can be switched between a closing state and an unfolding state; when in the closing state, the box body upper cover and the box body lower cover define a storage cavity used for storing articles; a box lock is mounted between the box body upper cover and the box body lower cover; the box lock is used for locking the box body upper cover and the box body lower cover in the closing state; any one of the box body upper cover and the box body lower cover is provided with a window, and the other one of the box body upper cover and the box body lower cover is provided with a handle positioned in the storage cavity so that the box body upper cover and the box body lower cover are spliced to form a shield in the unfolding state; an opening and closing locking mechanism is also arranged between the box body upper cover and the box body lower cover; and the opening and closing locking mechanism is used for locking the box body upper cover and the box body lower cover in the unfolding state.

As a further improvement of the disclosure, the opening and closing locking mechanism includes an opening and closing lock pin and a lock pin clamping plate; the opening and closing lock pin is fixedly connected to one of the box body upper cover and the box body lower cover, and the lock pin clamping plate is movably connected to the other one of the box body upper cover and the box body lower cover; moreover, an elastic force is applied to the lock pin clamping plate all the time through an elastic piece; the opening and closing lock pin is provided with a clamping stopping position; when the box body upper cover and the box body lower cover are in a non-unfolding state, the lock pin clamping plate is outside the clamping stopping position of the opening and closing lock pin; and when the box body upper cover and the box body lower cover are in the unfolding state, the lock pin clamping plate falls into the clamping stopping position through the elastic force of the elastic piece, and accordingly locking is realized.

As a further improvement of the disclosure, the box body upper cover is provided with an upper cover hinging side plate, and the box body lower cover is provided with a lower cover hinging side plate; the upper cover hinging side plate is rotationally connected to the lower cover hinging side plate; and when the box body upper cover and the box body lower cover are in the unfolding state, the upper cover hinging side plate abuts against the lower cover hinging side plate.

As a further improvement of the disclosure, the opening and closing lock pin is cylindrical and is fixed to the upper cover hinging side plate; an avoiding groove is formed along the periphery of the opening and closing lock pin in a cutting manner, and a clamping and locking face is formed on one side wall of the avoiding groove; and when the lock pin clamping plate is at the clamping stopping position, the lock pin clamping plate is attached to the clamping and locking face to realize locking.

As a further improvement of the disclosure, the handle is fixedly connected to the box body lower cover; the lock pin clamping plate is mounted on the handle in a sliding manner; and when the box body upper cover and the box body lower cover are in the non-unfolding state, the lock pin clamping plate elastically abuts against the periphery of the opening and closing lock pin through the elastic force of the elastic piece.

As a further improvement of the disclosure, the opening and closing locking mechanism further includes an opening and closing releasing key; the lock pin clamping plate is fixed to the bottom of the opening and closing releasing key; the elastic piece is arranged between the opening and closing releasing key and the handle; and the opening and closing releasing key is used for driving the lock pin clamping plate to upwards move away from the clamping stopping position when being pressed upwards so as to release the unfolding state from locking.

As a further improvement of the disclosure, the box body lower cover is further provided with a lower cover front side plate opposite to the lower cover hinging side plate; and the handle is in an inverted U shape, and the two ends of the handle are fixedly connected to the middle of the lower cover hinging side plate and the middle of the lower cover front side plate.

As a further improvement of the disclosure, the window is arranged in the middle of the box body upper cover; and when the box body upper cover and the box body lower cover are in the closing state, the handle and the window are oppositely distributed.

As a further improvement of the disclosure, the box lock includes lock bolts arranged on the handle, a lock body, a mechanical keyhole, a control module, a private key input module, a motor, and a battery; the lock body, the mechanical keyhole, the control module, the private key input module, the motor, and the battery are all mounted on the box body upper cover; the lock body is provided with a lock pin used in cooperation with the lock bolts; the mechanical keyhole is used for allowing a key to be inserted to drive the lock body to act, thus realizing locking or unlocking through the lock pin and the lock bolts; the private key input module is used for inputting an unlocking instruction to the control module; the control module is used for controlling the motor to drive the lock body to act, thus realizing locking or unlocking through the lock pin and the lock bolts; and the battery is used for supplying power to the control module, the private key input module, and the motor.

As a further improvement of the disclosure, the box body upper cover and the box body lower cover are each provided with a lifting handle.

The disclosure has the beneficial effects that: according to the weapon storage box with the defense function provided by the disclosure, the window and the handle are correspondingly arranged on the box body upper cover and the box body lower cover, so that the box body upper cover and the box body lower cover can be spliced to form the shield in the unfolding state, and the opening and closing locking mechanism is used for realizing the locking state; the handle can be held by the user; the window is used for the user to observe the condition in front; therefore, the weapon storage box can be used as a box for storing weapons and can be carried around; and when opening and taking out the weapons, the weapon storage box can be used as the shield to protect the personal safety of the user in time.

DETAILED DESCRIPTION OF THE EMBODIMENTS

A preferred embodiment of the present invention will be described in detail below in conjunction with the accompanying drawings.

As shown in FIG. 1 to FIG. 8, the disclosure provides a weapon storage box with a defense function, including a box body upper cover 1, and a box body lower cover 2. There is no requirement for the shape of the box body upper cover 1 and the box body lower cover 2; and in this embodiment, the box body upper cover 1 and the box body lower cover 2 are both approximately rectangular. The box body upper cover 1 and the box body lower cover 2 are rotationally connected; and when one of the box body upper cover 1 and the box body lower cover 2 rotates relative to the other one, the box body upper cover and the box body lower cover can be switched between a closing state and a unfolding state.

Figure 1:
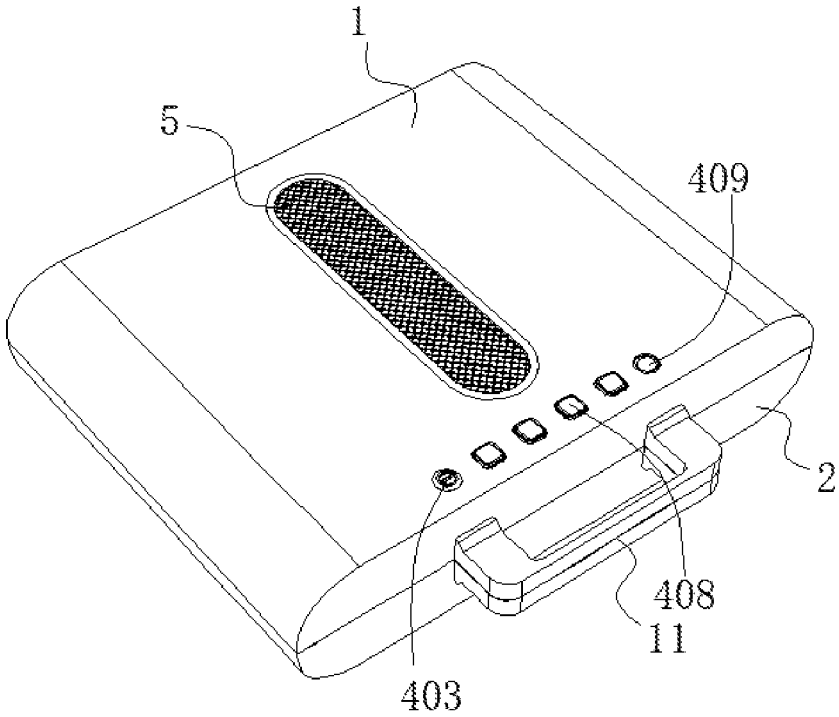
FIG. 1 is a three-dimensional diagram of a weapon storage box with a defense function in a closing state according to the disclosure.

The closing state is shown in FIG. 1, namely, the box body upper cover 1 completely covers the top of the box body lower cover 2; and when in the closing state, the box body upper cover 1 and the box body lower cover 2 define a storage cavity 3 used for storing articles (such as weapons like guns, spontons and knives). In addition, a box lock 4 is further mounted between the box body upper cover 1 and the box body lower cover 2; the box lock 4 is used for locking the box body upper cover 1 and the box body lower cover 2 in the closing state; moreover, the box lock 4 has the functions of a mechanical lock and an electronic lock; and a user can unlock only with a mechanical key or an unlocking instruction, and therefore the safety of the weapon storage box is improved.

Figure 5:
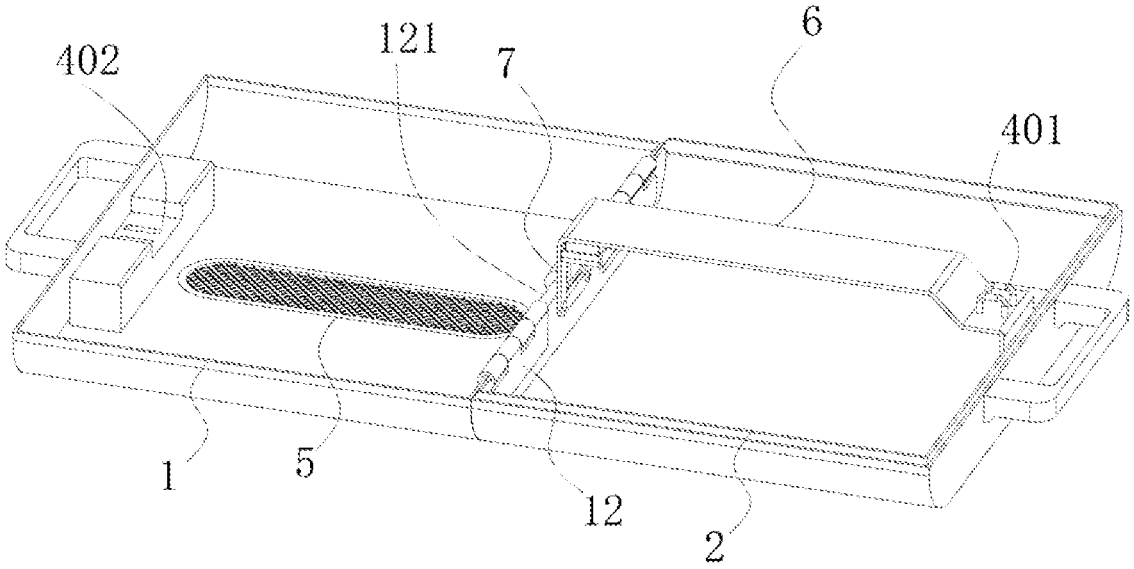
FIG. 5 is a three-dimensional diagram of a weapon storage box with a defense function in an unfolding state according to the disclosure.
Figure 6:
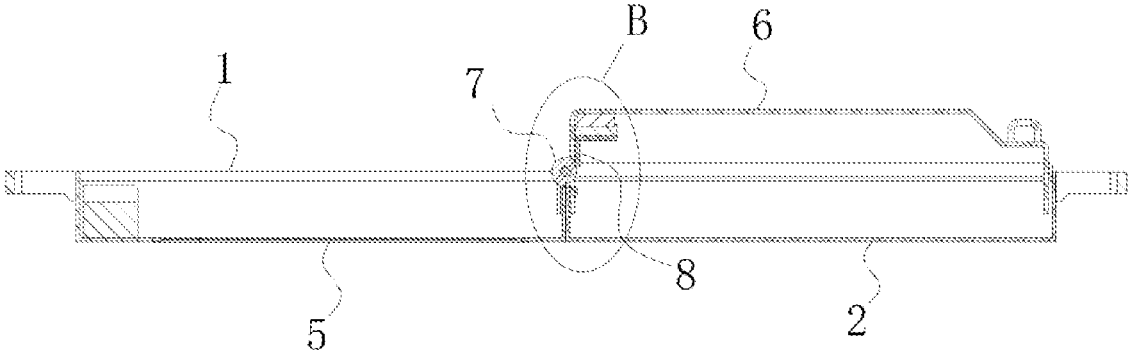
FIG. 6 is a sectional view of a weapon storage box with a defense function in an unfolding state according to the disclosure.

The unfolding state is shown in FIG. 5, that is, the box body upper cover 1 is rotated to a position flush with or close to the box body lower cover 2. Specifically, in this embodiment, the box body upper cover 1 and the box body lower cover 2 are distributed at 180°.

As an important improvement of the disclosure, any one of the box body upper cover 1 and the box body lower cover 2 is provided with a window 5, and the other one of the box body upper cover 1 and the box body lower cover 2 is provided with a handle 6 positioned in the storage cavity 3; and therefore when the box body upper cover 1 and the box body lower cover 2 are in the unfolding state, the box body upper cover 1 and the box body lower cover 2 are spliced to form a shield; the handle 6 can be held by the user; and the window 5 is used for the user to observe the condition in front. Thus, the weapon storage box according to the disclosure can be used as a box for storing weapons and can be carried around; and when opening and taking out the weapons, the weapon storage box can be used as the shield to protect the personal safety of the user in time.

In this embodiment, the window 5 is specifically arranged on the box body upper cover 1, and the handle 6 is specifically arranged on the box body lower cover 2.

Figure 4:
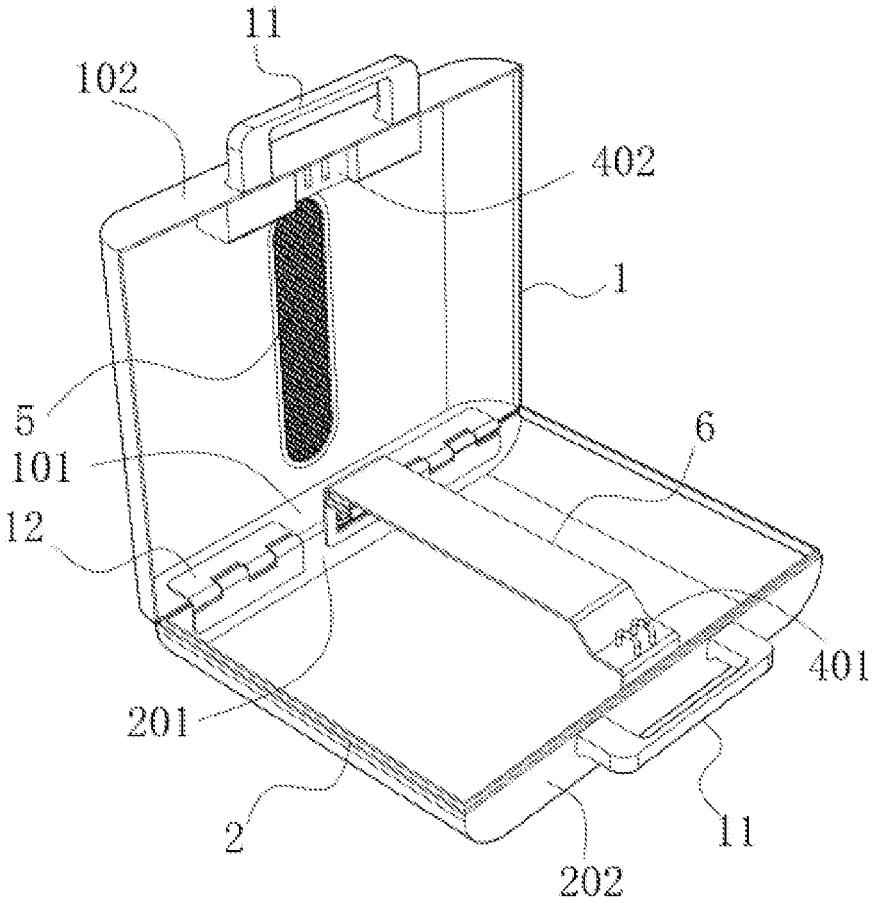
FIG. 4 is a three-dimensional diagram of a weapon storage box with a defense function in an incompletely opened state according to the disclosure.

As shown in FIG. 4, the box body lower cover 2 is provided with a lower cover hinging side plate 201 used for being rotationally connected with the box body upper cover 1, and a lower cover front side plate 202 opposite to the lower cover hinging side plate 201; the handle 6 is in an inverted U shape and is provided with two vertical plates and a cross beam integrally connected to the tops of the two vertical plates; the two vertical plates are fixedly connected to the middle of the inner side face of the lower cover hinging side plate 201 and the middle of the inner side face of the lower cover front side plate 202 correspondingly; and the cross beam of the handle 6 is used for being handheld.

Figure 2:
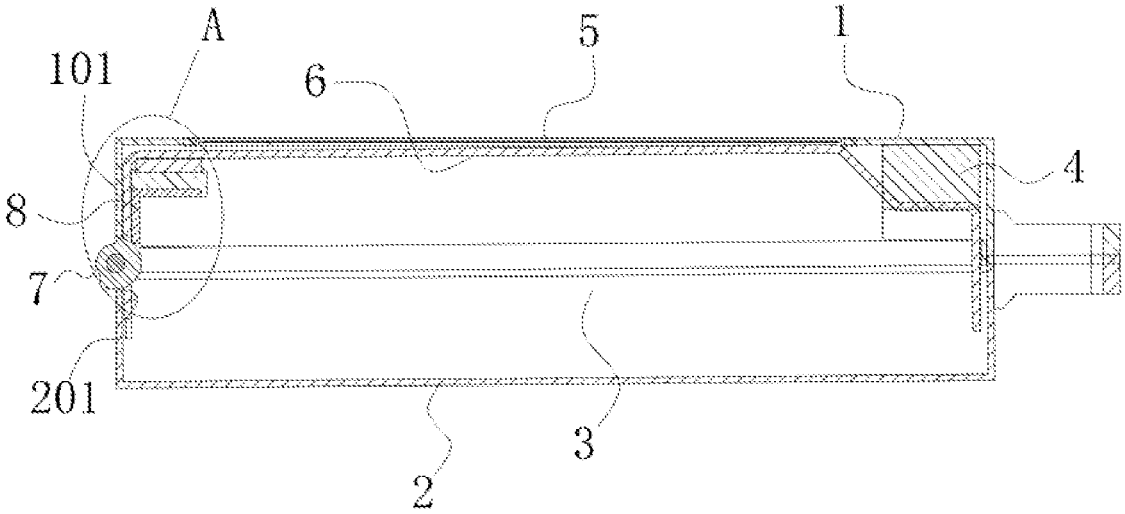
FIG. 2 is a sectional view of a weapon storage box with a defense function in a closing state according to the disclosure.

The window 5 may be made of visual protection materials like a steel wire mesh and bulletproof glass, or may be made into a model with bulletproof arrangement punched holes at the same position. In this embodiment, the window 5 is made of the steel wire mesh and is fixedly arranged in the middle of the box body upper cover 1. When the box body upper cover 1 and the box body lower cover 2 are in the unfolding state, the window 5 and the handle 6 are distributed along the same straight line; when the box body upper cover 1 and the box body lower cover 2 are in the closing state, the handle 6 and the window 5 are oppositely distributed, and the handle 6 covers the bottom of the window 5, may be attached to the window 5, and may also be oppositely distributed with the window 5 at a small gap interval (as shown in FIG. 2); and therefore, the storage cavity 3 can be prevented from being entered through external force or tools from the window 5, and the safety of the weapon storage box is guaranteed.

Definitely, in other embodiments of the disclosure, the mounting positions of the window 5 and the handle 6 may be exchanged, namely, the window 5 is arranged on the box body lower cover 2, the handle 6 is arranged on the box body upper cover 1, and the requirements of taking the weapon storage box as the shield and ensuring the safety of the weapon storage box can also be met.

The box body upper cover 1 and the box body lower cover 2 can be made of bulletproof steel plates and the like.

It is to be noted that when the box body upper cover 1 and the box body lower cover 2 are in the unfolding state, the box body upper cover 1 and the box body lower cover 2 cannot rotate relatively so as to meet the function requirement of the shield. Therefore, according to the disclosure, the upper cover hinging side plate 101 used for being rotationally connected with the box body lower cover 2 is arranged on the box body upper cover 1, and the upper cover hinging side plate 101 and the lower cover hinging side plate 201 are hinged through a plurality of hinges 12; when the box body upper cover 1 and the box body lower cover 2 are in the unfolding state, the upper cover hinging side plate 101 and the lower cover hinging side plate 201 abut against each other; and under mutual stopping of the upper cover hinging side plate 101 and the lower cover hinging side plate 201, the box body upper cover 1 cannot perform further opening rotation action relative to the box body lower cover 2 (as shown in FIG. 5, the opening rotation direction is the anticlockwise direction). In addition, according to the disclosure, the opening and closing locking mechanism is further arranged between the box body upper cover 1 and the box body lower cover 2; when the box body upper cover 1 and the box body lower cover 2 are in the unfolding state, the box body upper cover 1 is limited by the opening and closing locking mechanism to perform closing rotation action relative to the box body lower cover 2 (as shown in FIG. 5, the closing rotation direction is the clockwise direction), and therefore the box body upper cover 1 and the box body lower cover 2 are locked in the unfolding state.

Figure 3:
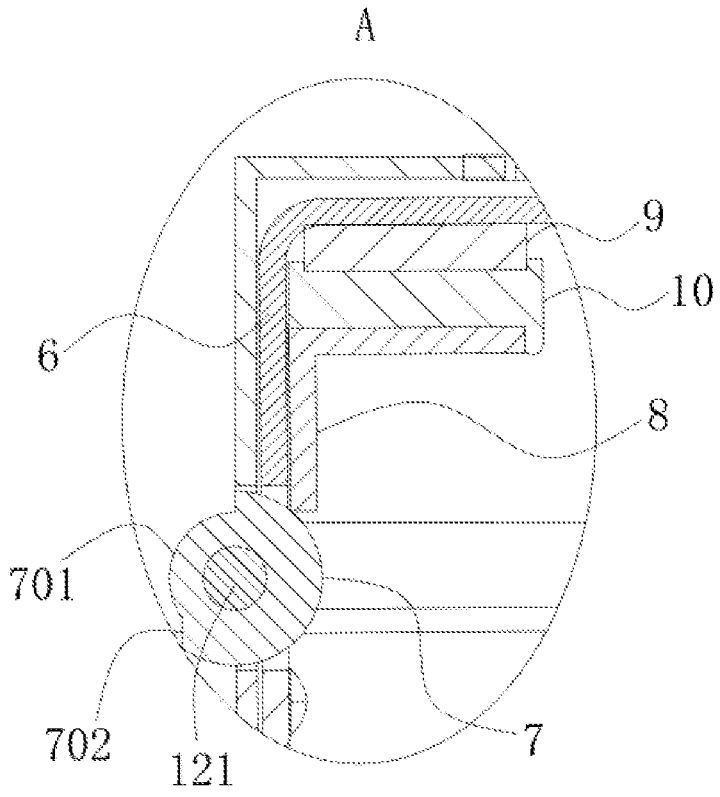
FIG. 3 is an enlarged diagram of A in FIG. 2 according to the disclosure.
Figure 7:
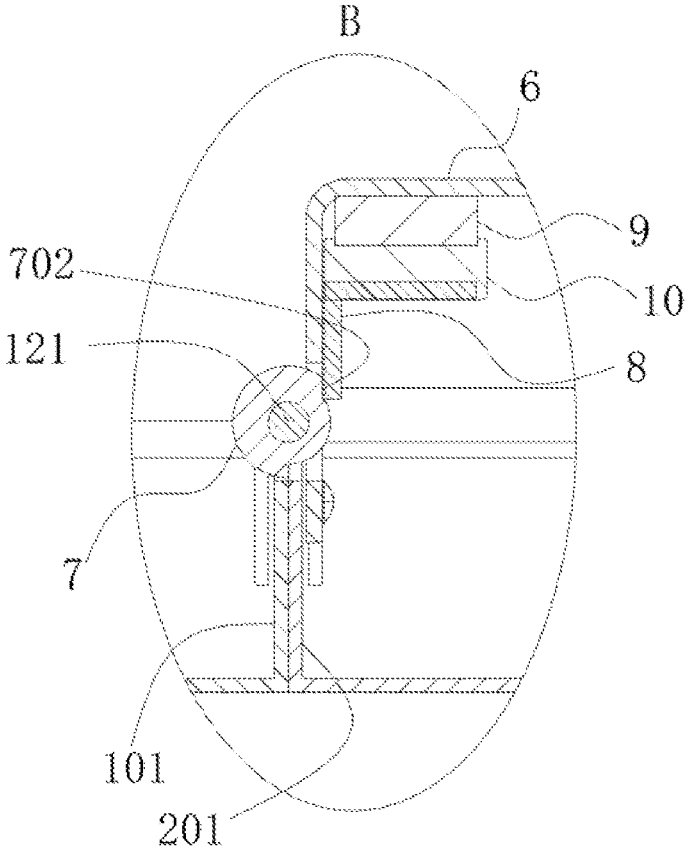
FIG. 7 is an enlarged diagram of B in FIG. 6 according to the disclosure.

As shown in FIG. 3 and FIG. 7, the opening and closing locking mechanism includes an opening and closing lock pin 7 and a lock pin clamping plate 8; the opening and closing lock pin 7 is fixedly connected to one of the box body upper cover 1 and the box body lower cover 2, the lock pin clamping plate 8 is movably connected to the other one of the box body upper cover 1 and the box body lower cover 2, and an elastic force is applied to the lock pin clamping plate 8 all the time by an elastic piece 9. A clamping stopping position is arranged on the opening and closing lock pin 7; and when the box body upper cover 1 and the box body lower cover 2 are in a non-unfolding state, the lock pin clamping plate 8 is outside the clamping stopping position of the opening and closing lock pin 7; and when the box body upper cover 1 and the box body lower cover 2 are in the unfolding state, the lock pin clamping plate 8 falls into the clamping stopping position through elastic force of the elastic piece 9, and therefore locking is realized.

Specifically, as shown in FIG. 5, a hinge rotating shaft 121 is arranged on the hinges 12, and the hinge rotating shaft 121 is fixedly connected to the upper cover hinging side plate 101. The opening and closing lock pin 7 is cylindrical and is fixed to the upper cover hinging side plate 101 through the hinge rotating shaft 121, so that the opening and closing lock pin 7 can synchronously rotate when the box body upper cover 1 performs opening rotation action and closing rotation action. A fan-ring-shaped avoiding groove 701 is formed along the periphery of the opening and closing lock pin 7 in a cutting manner, and a clamping and locking face 702 is formed on one side wall of the avoiding groove 701; and when the lock pin clamping plate 8 is at the clamping stopping position, the lock pin clamping plate 8 is attached to the clamping and locking face 702 to realize locking (as shown in FIG. 7), and therefore the situation that the box body upper cover 1 is limited to perform closing rotation action relative to the box body lower cover 2.

As shown in FIG. 3 and FIG. 7, the opening and closing locking mechanism further includes an opening and closing releasing key 10; the lock pin clamping plate 8 is fixed to the bottom of the opening and closing releasing key 10; the lock pin clamping plate 8 and the opening and closing releasing key 10 can be mounted on the handle 6 in a sliding manner through components such as shoulder bolts and guide columns; and the lock pin clamping plate 8 is distributed on one side of a corresponding vertical plate on the handle 6 in the vertical direction. The elastic piece 9 is arranged between the opening and closing releasing key 10 and the cross beam of the handle 6; the elastic piece 9 is a spring set composed of a plurality of springs; and the elastic piece applies a downward elastic force on the lock pin clamping plate 8 all the time through the opening and closing releasing key 10. When the box body upper cover 1 and the box body lower cover 2 are in the non-unfolding state, the lock pin clamping plate 8 elastically abuts against the periphery of the opening and closing lock pin 7 through the elastic force of the elastic piece 9.

As shown in FIG. 3, when the box body upper cover 1 and the box body lower cover 2 are in the closing state, the lock pin clamping plate 8 elastically abuts against the peripheral surface of the opening and closing lock pin 7 through the elastic force of the elastic piece 9. In the process that the box body upper cover 1 performs cover opening rotation action relative to the box body lower cover 2, the opening and closing lock pin 7 is driven by the box body upper cover 1 to rotate synchronously, and at the moment, the peripheral surface of the opening and closing lock pin 7 slides relative to the lower end of the lock pin clamping plate 8; and until the box body upper cover 1 rotates relative to the box body lower cover 2 to reach the unfolding state, the avoiding groove 701 in the opening and closing lock pin 7 just rotates to a position under the lock pin clamping plate 8, the lock pin clamping plate 8 moves downwards with the elastic force of the elastic piece 9 so as to fall into the avoiding groove 701 (namely the clamping stopping position), the lock pin clamping plate 8 and the clamping locking surface 702 are attached to each other to form a stop catch, thus the box body upper cover 1 and the box body lower cover 2 are locked in the unfolding state, and the weapon storage box can be used as the shield to protect the personal safety of the user. In a case of closing the covers, the opening and closing releasing key 10 is forcibly pressed upwards, the lock pin clamping plate 8 will be driven to upwards move away from the avoiding groove 701, namely the clamping stopping position, so as to release the unfolding state from locking, and then the box body upper cover 1 may perform closing rotation action relative to the box body lower cover 2.

Further, the box lock 4 includes lock bolts 401, a lock body 402, a mechanical keyhole 403, a control module 404, a private key input module, a motor 405, and a battery 406. As shown in FIG. 4, the end, close to the lower cover front side plate 202, of the cross beam of the handle 6 is bent to form an avoiding groove, and the lock bolts 401 are fixedly arranged on the top of the cross beam of the handle 6 and positioned in the avoiding groove. The lock body 402, the mechanical keyhole 403, the control module 404, the private key input module, the motor 405, and the battery 406 are all mounted on the box body upper cover 1. The lock body 402 is provided with a lock groove, and a lock pin 407 positioned in the lock groove. When the box body upper cover 1 and the box body lower cover 2 are in the closing state, the lock bolts 401 are inserted into the lock groove and used in cooperation with the lock pin 407 for locking or unlocking.

Figure 8:
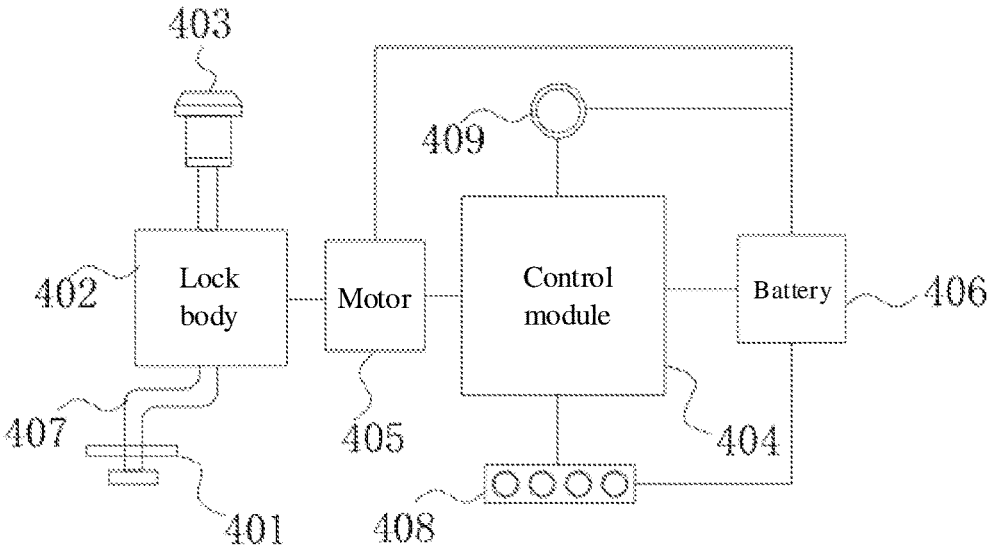
FIG. 8 is a control principle block diagram of a box lock according to the disclosure.

As shown in FIG. 1 and FIG. 8, the mechanical keyhole 403 is formed in the top of the box body upper cover 1 and used for allowing a key to be inserted to drive the lock body 402 to act, thus realizing locking or unlocking through the lock pin 407 and the lock bolts 401. The private key input module is electrically connected to the control module 404 and used for inputting an unlocking instruction to the control module 404, and the control module 404 can control the motor 405 to drive the lock body 402 to act according to the received unlocking instruction, thus realizing unlocking through the lock pin 407 and the lock bolts 401. The control module 404 can also control the motor 405 to drive the lock body 402 to act, thus realizing locking through the lock pin 407 and the lock bolts 401.

According to the disclosure, the private key input module includes but is not limited to password input keys 408 and a fingerprint recognition module 409 which are both arranged on the top of the box body upper cover 1; and the user may input password through the password input keys 408 to unlock, and may also input fingerprint through the fingerprint recognition module 409 to unlock.

It is to be noted that the specific structures of the lock body 402 of the box lock 4, the control module 404 and the private key input module according to the disclosure are not used as the improvement of the disclosure and are all in the existing technology.

The control module 404, the private key input module, and the motor 405 are all electrically connected to the battery 406, and the battery 406 supplies power to the control module 404, the private key input module, and the motor 405.

According to the disclosure, the box lock 4 with the functions of a mechanical lock and an electronic lock is adopted, which may be rapidly unlocked through the private key input module, and may also prevent a situation that the battery is out of power to cause unlocking failure.

As shown in FIG. 4, an upper cover front side plate 102 opposite to the upper cover hinging side plate 101 is arranged on the box body upper cover 1, and lifting handles 11 are arranged on the outer side of the upper cover front side plate 102 and the outer side of the lower cover front side plate. When the box body upper cover 1 and the box body lower cover 2 are in the closing state, the two lifting handles 11 are combined to facilitate handholding for carrying; and the box body upper cover 1 can be conveniently opened through the lifting handle 11 on the upper cover front side plate 102.

In conclusion, according to the weapon storage box with the defense function provided by the disclosure, the window 5 and the handle 6 are correspondingly arranged on the box body upper cover 1 and the box body lower cover 2, so that the box body upper cover 1 and the box body lower cover 2 can be spliced to form the shield in the unfolding state, and the opening and closing locking mechanism is used for realizing the locking state; the handle 6 can be held by the user; the window 5 is used for the user to observe the condition in front; therefore, the weapon storage box can be used as a box for storing weapons and can be carried around; and when opening and taking out the weapons, the weapon storage box can be used as the shield to protect the personal safety of the user in time.

In the above description, numerous specific details are set forth to facilitate a thorough understanding of the disclosure. However, the above description is only a preferred embodiment of the disclosure. The disclosure can be implemented in many other ways different from those described here, so the disclosure is not limited to the specific implementation disclosed above. At the same time, any person skilled in the art can make many possible changes and modifications to the technical solution of the disclosure using the methods and technical content disclosed above without departing from the scope of the technical solution of the disclosure, or modify it into equivalent implementations with equivalent changes. Any simple modifications, equivalent changes, and modifications made to the above embodiments based on the technical essence of the disclosure without departing from the content of the technical solution of the disclosure still fall within the protection scope of the technical solution of the disclosure.

What is claimed is:

1. A weapon storage box with a defense function, comprising a box body upper cover, and a box body lower cover;

wherein the box body upper cover and the box body lower cover are rotationally connected and are capable of switching between a closing state and an unfolding state;

when in the closing state, the box body upper cover and the box body lower cover define a storage cavity used for storing articles;

a box lock is arranged between the box body upper cover and the box body lower cover;

the box lock is used for locking the box body upper cover and the box body lower cover in the closing state;

any one of the box body upper cover and the box body lower cover is provided with a window, and the other one of the box body upper cover and the box body lower cover is provided with a handle positioned in the storage cavity so that the box body upper cover and the box body lower cover are spliced to form a shield in the unfolding state;

an opening and closing locking mechanism is also arranged between the box body upper cover and the box body lower cover; and the opening and closing locking mechanism is used for locking the box body upper cover and the box body lower cover in the unfolding state;

wherein the opening and closing locking mechanism comprises an opening and closing lock pin and a lock pin clamping plate:

the opening and closing lock pin is fixedly connected to one of the box body upper cover and the box body lower cover, and the lock pin clamping plate is movably connected to an other one of the box body upper cover and the box body lower cover:

an elastic force is applied to the lock pin clamping plate all the time through an elastic piece; and the opening and closing lock pin is provided with a clamping stopping position:

when the box body upper cover and the box body lower cover are in a non-unfolding state, the lock pin clamping plate is outside the clamping stopping position of the opening and closing lock pin; and when the box body upper cover and the box body lower cover are in the unfolding state, the lock pin clamping plate falls into the clamping stopping position through the elastic force of the elastic piece, and accordingly locking is realized.

2. The weapon storage box with the defense function according to claim 1, wherein the box body upper cover is provided with an upper cover hinging side plate, and the box body lower cover is provided with a lower cover hinging side plate;

the upper cover hinging side plate is rotationally connected to the lower cover hinging side plate; and when the box body upper cover and the box body lower cover are in the unfolding state, the upper cover hinging side plate abuts against the lower cover hinging side plate.

3. The weapon storage box with the defense function according to claim 2, wherein the opening and closing lock pin is cylindrical and is fixed to the upper cover hinging side plate;

an avoiding groove is formed along the periphery of the opening and closing lock pin in a cutting manner, and a clamping and locking face is formed on one side wall of the avoiding groove; and when the lock pin clamping plate is at the clamping stopping position, the lock pin clamping plate is attached to the clamping and locking face to realize locking.

4. The weapon storage box with the defense function according to claim 3, wherein the handle is fixedly connected to the box body lower cover;

the lock pin clamping plate is mounted on the handle in a sliding manner; and when a box body upper cover and the box body lower cover are in the non-unfolding state, the lock pin clamping plate elastically abuts against the periphery of the opening and closing lock pin through the elastic force of the elastic piece.

5. The weapon storage box with the defense function according to claim 4, wherein the opening and closing locking mechanism further comprises an opening and closing releasing key;

the lock pin clamping plate is fixed to the bottom of the opening and closing releasing key;

the elastic piece is arranged between the opening and closing releasing key and the handle; and the opening and closing releasing key is used for driving the lock pin clamping plate to upwards move away from the clamping stopping position when being pressed upwards so as to release the unfolding state from locking.

6. The weapon storage box with the defense function according to claim 4, wherein the box body lower cover is further provided with a lower cover front side plate opposite to the lower cover hinging side plate; and the handle is in an inverted U shape, and the two ends of the handle are fixedly connected to the middle of the lower cover hinging side plate and the middle of the lower cover front side plate.

7. The weapon storage box with the defense function according to claim 6, wherein the window is arranged in the middle of the box body upper cover; and when the box body upper cover and the box body lower cover are in the closing state, the handle and the window are oppositely distributed.

8. The weapon storage box with the defense function according to claim 6, wherein the box lock comprises lock bolts arranged on the handle, a lock body, a mechanical keyhole, a control module, a private key input module, a motor, and a battery;

the lock body, the mechanical keyhole, the control module, the private key input module, the motor, and the battery are all mounted on the box body upper cover;

the lock body is provided with a lock pin used in cooperation with the lock bolts;

the mechanical keyhole is used for allowing a key to be inserted to drive the lock body to act, thus realizing locking or unlocking through the lock pin and the lock bolts;

the private key input module is used for inputting an unlocking instruction to the control module;

the control module is used for controlling the motor to drive the lock body to act, thus realizing locking or unlocking through the lock pin and the lock bolts; and the battery is used for supplying power to the control module, the private key input module and the motor.

9. The weapon storage box with the defense function according to claim 1, wherein the box body upper cover and the box body lower cover are each provided with a lifting handle.

* * * * *